United States Patent [19]

Yasuda et al.

[11] Patent Number: 4,564,285

[45] Date of Patent: Jan. 14, 1986

[54] DEVELOPING DEVICE HAVING DISPERSED FLOATING ELECTRODES IN A DIELECTRIC LAYER

[75] Inventors: Wataru Yasuda, Yokohama; Koji Sakamoto, Tokyo; Fuchio Kanno, Yokohama, all of Japan

[73] Assignee: Ricoh Company, Ltd., Japan

[21] Appl. No.: 498,988

[22] Filed: May 27, 1983

[30] Foreign Application Priority Data

| | | | |
|---|---|---|---|
| May 31, 1982 | [JP] | Japan | 57-91448 |
| Jun. 7, 1982 | [JP] | Japan | 57-96344 |
| Jun. 7, 1982 | [JP] | Japan | 57-96345 |
| Jun. 25, 1982 | [JP] | Japan | 57-108390 |

[51] Int. Cl.[4] ..... G03G 15/08

[52] U.S. Cl. ..... 355/3 DD; 355/14 D; 118/648; 118/651

[58] Field of Search ..... 355/3 DD, 14 D, 3 R, 355/3 CH; 118/647-651, 657-658

[56] References Cited

U.S. PATENT DOCUMENTS

| | | | |
|---|---|---|---|
| 4,348,979 | 9/1982 | Daintrey | 118/657 X |
| 4,423,950 | 1/1984 | Sagami | 355/3 DD X |
| 4,428,661 | 1/1984 | Masuda et al. | 355/3 DD |
| 4,431,296 | 2/1984 | Haneda et al. | 355/3 DD |
| 4,435,065 | 3/1984 | Wada | 355/3 DD |
| 4,436,413 | 3/1984 | Oka | 355/3 DD X |
| 4,445,771 | 5/1984 | Sakamoto et al. | 118/657 X |
| 4,451,133 | 5/1984 | Kopp et al. | 355/3 DD |
| 4,459,009 | 7/1984 | Hays et al. | 355/3 DD |
| 4,460,266 | 7/1984 | Kopp et al. | 355/3 DD |
| 4,478,505 | 10/1984 | Tashiro | 355/14 D X |

*Primary Examiner*—A. C. Prescott
*Assistant Examiner*—Terrance L. Flower
*Attorney, Agent, or Firm*—Guy W. Shoup

[57] ABSTRACT

A developing device includes a developing sleeve driven to rotate to transport a film of developer riding on its outer peripheral surface, the developing sleeve including an electrically conductive cylinder, a dielectric layer formed on the cylinder and a plurality of fine electrodes provided electrically isolated from each other at least at the outer peripheral surface of the dielectric layer. In one form, each of the fine electrodes is previously coated with an insulating material having the volume resistivity of $10^{12}$ ohms-cm or more to a thickness of 0.5 microns to 0.5 mm. An intermediate dielectric layer may be provided between the cylinder and the first dielectric layer. Further, an electrically conductive layer may be provided as sandwiched between the two dielectric layers. Moreover, the outermost surface of the sleeve may be appropriately roughened in view of the average diameter of toner particles used.

16 Claims, 32 Drawing Figures

DEVELOPING DEVICE HAVING DISPERSED FLOATING ELECTRODES IN A DIELECTRIC LAYER

BACKGROUND OF THE INVENTION

1. Field of the Invention

This invention generally relates to a developing device for developing an electrostatic latent image formed on an image bearing member to convert the latent image into a visual image, and in particular, to a developer transporting unit for transporting as carried thereon a layer of developer to be applied to the latent image for visualization. More specifically, the present invention relates to a floating electrode type developing device which includes a plurality of small-sized electrodes which are electrically floating and function as auxiliary electrodes.

2. Description of the Prior Art

A device for developing an electrostatic latent image formed on an image bearing member comprised of a conductive support and a photoconductive layer formed on the support has been widely used in electrophotographic copiers, electrostatic recording machines and various other types of machines. In the developing technology, electrostatic latent images may be categorized into two different classes depending upon the degree of their spatial frequencies. One of them includes "line images" which are mainly comprised of higher spatial frequency components, and the other class includes "area images" having lower spatial frequency components. The line image is an image mainly formed by lines appropriately arranged to indicate a pattern or character; on the other hand, the area image implies an image having a relatively large two-dimensional section to be developed such as a picture.

It is to be noted that required developing conditions differ depending upon the class of image, i.e., whether it is a line image or area image. Stated more in detail, in the case of area images, it is normally required that the developing density vary depending upon the level of the surface potential of an electrostatic latent image to be developed so as to express tone or shading variation. On the other hand, in the case of line images, the developing density is normally required to be always high irrespective of the level of the surface potential of a latent image to be developed. In other words, a line image is usually desired to be developed to a high density image even if the surface potential of its latent image is very low.

Such dual requirements in development are satisfied as long as use is made of a two component developer comprised of toner and carrier beads. However, in developing devices using a single component developer comprised of magnetic toner particles, difficulty has been experienced in satisfying the above-noted dual requirements. Under the circumstances, there has also been proposed an improved developing device using a single component developer which could satisfy the above-noted requirements as disclosed in the Japanese Patent Application No. 55-185726. The proposed developing device is characterized by using a novel developer carrier including a conductive support and a plurality of conductive particles provided on the support such that the particles are electrically isolated from one another as well as from the support thereby the conductive particles function as fine floating electrodes. With such a structure, the above-noted dual requirements may be satisfied sufficiently.

Several methods for manufacturing a developer transporting unit having the above-described structure have also been proposed as will be briefly reviewed below.

(a) Conductive particles of metal are first mixed with a dielectric resin material and such a mixture is then deposited on a conductive support.

(b) An adhesive agent is first applied to a conductive support and then conductive particles are spread thereon.

(c) A dielectric layer is first formed on a conductive support and then a conductive layer is formed on the dielectric layer. Then the conductive layer is converted into a pattern of islands each forming a fine electrode, for example, by etching.

However, in accordance with the above-described method (a), as the mixture ratio of the particles increases as compared with the resin, it becomes increasingly difficult to form a layer of the mixture on the support. Thus, the mixture ratio is rather limited. The above-described method (b) also suffers from disadvantages because the resulting surface is significantly irregular and thus it is impossible to form a developer layer of uniform thickness. Besides, the particles are rather prone to come off, indicating a poor service life. The prior art method (c) tends to be expensive thereby necessarily increasing manufacturing cost.

SUMMARY OF THE INVENTION

The disadvantages of the prior art are obviated by the present invention and an improved device for developing an electrostatic latent image is provided.

Therefore, it is a primary object of the present invention to provide a developing device having a high developing efficiency.

Another object of the present invention is to provide a device for developing an electrostatic latent image formed on an image support member, which includes a plurality of fine floating electrodes functioning as auxiliary electrodes in image development.

A still further object of the present invention is to provide a developing device capable of maintaining a good contact between the developer unit on which a layer of developer is formed and the image support member on which an electrostatic latent image to be developed is formed.

A still further object of the present invention is to provide a developing device capable of preventing the occurrence of an undesired image such as a ghost image.

A still further object of the present invention is to provide a developing device capable of preventing the sticking of developer to the developer transporting unit on which a thin layer of developer is formed and brought to a developing station where an electrostatic latent image on an image support member is developed.

A still further object of the present invention is to provide a developing device capable of developing line images to a predetermined density level irrespective of the density level of an original image.

A still further object of the present invention is to provide a developing device which allows to varingly set a developing characteristic as desired in accordance with the state or kind of an original.

Other objects, advantages and novel features of the present invention will become apparent from the following detailed description of the invention when considered in conjunction with the accompanying drawings.

DESCRIPTION OF THE PREFERRED EMBODIMENTS

Figure 1A:
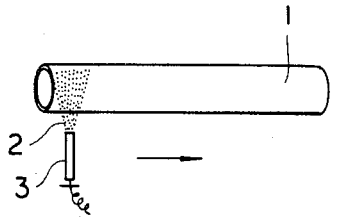
FIGS. 1*a* through 1*e* are schematic illustrations showing the steps of one method for manufacturing a developer transporting unit including a plurality of fine floating electrodes for use in a developing device of the present invention.

Referring to FIG. 1*a*, in forming a developer transporting unit, a conductive support 1 is prepared. In this embodiment, the support 1 is comprised of a cylinder, but the present invention should not be limited to such a particular shape and the support 1 may take any other appropriate shape such as a plate. If a developing device of the present invention uses magnetic toner, the developer transporting unit must be of non-magnetic nature, and therefore, in this case, the support 1 to be prepared must be comprised of a non-magnetic material such as aluminum or stainless steel.

Figure 2A:
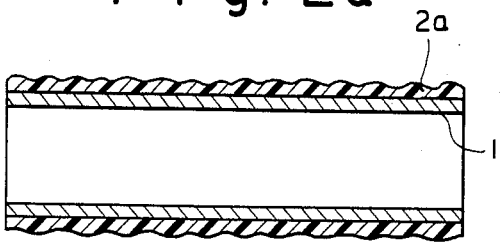
FIGS. 2*a* through 2*g* are cross-sectional views showing how the structure varies when the method shown in FIGS. 1*a* through 1*e* progresses.
Figure 2B:
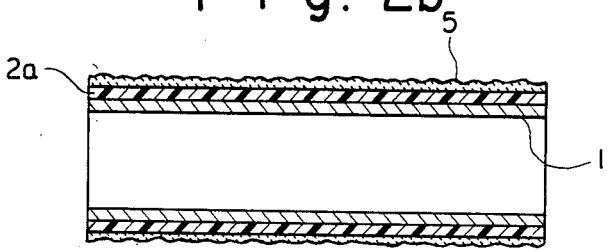

Then, the outer peripheral surface of the cylinder support 1 is subjected to any well known oil-removing treatment. Thereafter, dielectric powder 2 is sprayed onto the peripheral surface of the cylinder support 1, for example, by means of an electrostatic spray painting machine 3 as shown in FIG. 1*a*. The powder 2 may include thermoplastic resin powder or epoxy resin powder. The sprayed powder is then hardened by heating to form a dielectric layer 2*a* on the peripheral surface of the cylinder support 1 as shown in FIG. 2*a*. Since the outer surface of the thus formed dielectric layer 2*a* is usually irregular, the outer surface is ground to eliminate irregularities thereby presenting a smooth surface. After grinding, the dielectric layer 2*a* has the thickness of, for example, approximately 0.5 mm, as shown in FIG. 2*b*. Thus, the dielectric layer 2*a* defines an underlying layer on which a layer including a plurality of floating fine electrodes is to be formed.

Figure 1B:
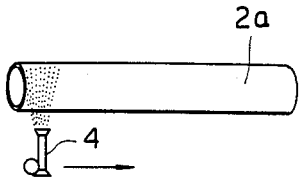
Figure 1C:
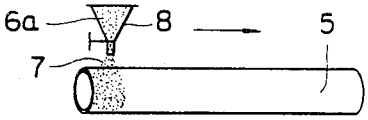

After grinding the dielectric layer 2*a* to a desired thickness, the outer ground surface is cleaned, and then an insulating adhesive material is sprayed onto the outer surface of the dielectric layer 2*a*, for example, by means of a pressurized air spray 4, as shown in FIG. 1*b*. As a result, as shown in FIG. 2*b*, the first adhesive layer 5 is formed overlying the dielectric layer 2*a*. The thickness of the layer 5 is typically 50 microns. The insulating adhesive material to be sprayed includes a two-part adhesive material, which hardens at normal temperatures, such as a liquid epoxy resin.

Figure 2C:
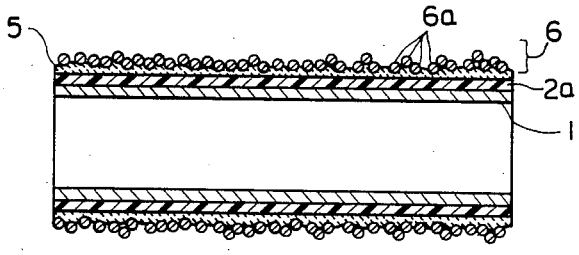

After application of the first adhesive material as described above and before it hardens substantially, conductive fine particles of, for example, metal are deposited on the first adhesive layer to form a layer 6 of conductive particles 6*a*, as shown in FIG. 2*c*. In order to have the conductive fine particles 6*a* deposited, use may be made of a hopper 8 containing therein a quantity of conductive fine particles 6*a*. The hopper 8 is provided with a supply port 7 at its bottom, which may be appropriately opened or closed to regulate the flow rate of the particles 6*a* to be discharged. Thus the particles 6*a* are caused to fall onto the first adhesive layer 2*a* formed on the cylinder support 1 as it rotates. It is to be noted that the conductive particles 6*a* are preferably coated with an insulating material. When use is made of such coated particles 6*a*, it is insured that the particles 6*a* are well electrically isolated from one another as well as from the conductive support 1 thereby allowing them to properly function as floating electrodes. As discussed above, it is rather important that conductive fine particles 6*a* be electrically isolated from one another in order to attain intended objectives. In this respect, it is preferable that the particles 6*a* are individually coated with a resin material having the volume resistivity of $10^{12}$ ohms-cm or more and the thickness ranging from 0.5 microns to 0.5 mm, preferably 0.5 microns to 0.1 mm. The diameter of the particles 6*a* may range between 10 and 500 microns, and the average diameter is preferred to be in the neighborhood of 100 microns.

As one example, aluminum particles were sieved to obtain classified particles having the diameter ranging between 70 and 80 microns. Then the classified particles were mixed into a solution containing an epoxy resin having the volume resistivity of $10^{14}$ ohms-cm. Such a mixture was then churned for approximately one hour in a ball mill to have the conductive particles of aluminum well dispersed in the molten resin. Thereafter, the mixture was sprayed and at the same time dried by means of a spray dryer to obtain epoxy-resin-coated conductive particles of aluminum. Such coating was found to be approximately 3 microns thick.

As another example of coated conductive particles, use was made of iron particles which had been sieved to have the size in the range between 40–50 microns. Then a solvent containing molten acrylic resin having the volume resistivity of $10^{15}$ ohms-cm was sprayed onto the iron particles and the sprayed solvent was allowed to dry so that the acrylic resin coating of approximately 1 micron thickness was formed on each of the iron particles.

Figure 1D:
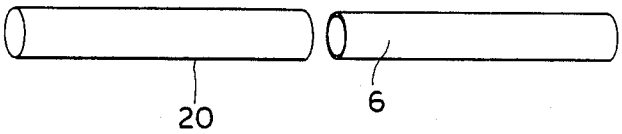
Figure 2D:
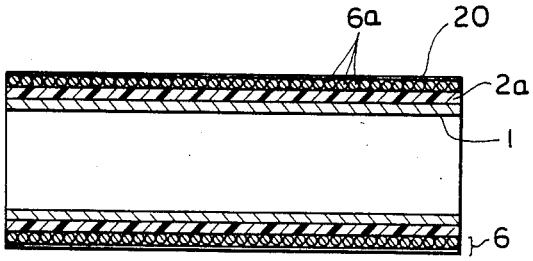

As shown in FIG. 1*d*, having deposited the particles 6*a* on the first adhesive layer 5, a thermally shirnkable tube 20 is fitted onto the cylinder support before the adhesive layer 5 hardens. When the tube 20 is heated, it shrinks to push the deposited particles 6*a* into the first adhesive layer 5 so that possible aggregates of particles 6*a* may be broken into individual particles and also the particles 6*a* become uniformly distributed across the peripheral surface. Preferably, the particles 6*a* are forced to be arranged to define a cylinder having the wall thickness equal to the diameter of the particles as shown in FIG. 2*d*. A polyester tube having the wall thickness of 50 microns may be used for this purpose, though it is not intended to limit to this particular example. If desired, this step of FIG. 1*d* may be skipped.

Figure 2E:
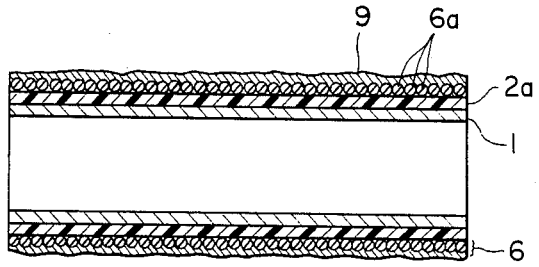

After removing the tube 20, an insulating adhesive material is additionally sprayed to form a second layer 9 of a second insulating adhesive material, as shown in FIG. 2*e*. The formation of the second adhesive layer 9 may be effected in the same manner as in the case of forming the first adhesive layer 5 as described previously in connection with FIG. 1*b*. Besides, the second adhesive material is preferably the same as the first adhesive material, because adhesiveness of the particles 6*a* may be enhanced.

Figure 2F:
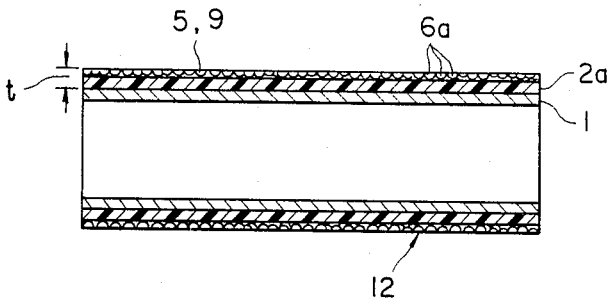

Upon formation of the second adhesive layer 9, it is allowed to harden completely, and then the resulting structure is ground to make its outer surface smooth and at the same time have at least some of the embedded conductive particles 6*a* exposed at the ground surface, as shown in FIG. 2*f*. Since the grinding is carried out from the outer peripheral surface, the embedded particles 6*a* are also ground partly when exposed at the outer surface so that the finished surface provides an extremely smooth surface without irregularities. This allows one to make a developer layer having a remarkably uniform thickness on the present developer transporting unit and therefore developing performance may be improved.

Figure 1E:
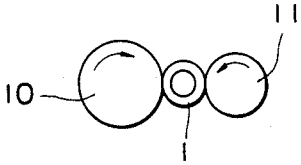

FIG. 1*e* shows the grinding step of the present method. As shown schematically, the grinding machine includes a first grinding wheel 10 which is driven to rotate clockwise and a second grinding wheel 11 which is driven to rotate counter-clockwise and spaced apart from the first grinding wheel 10. The structure shown in FIG. 2*e* is positioned inbetween the first and second grinding wheels 10, 11 to have its outer surface ground to cause at least some of the embedded particles 6*a* to be exposed. The grinding machine shown in FIG. 1*e* is a so-called centerless grinder, but it is to be noted that any other appropriate grinding method may be equally used.

Figure 2G:
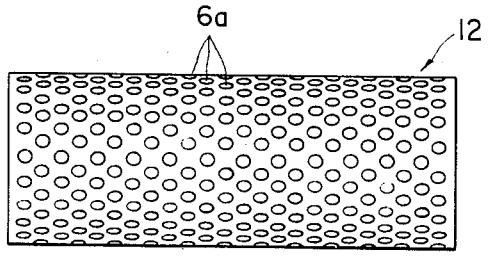

Upon completion of grinding, the resulting structure is cleaned to remove abrasives and ground debris, followed by checking of the outer diameter of the resulting structure, if necessary. In this manner, manufacture of the present developer transporting unit 12 is completed, and the finished product as a result of the present manufacturing process is shown in FIG. 2*g*. When completed, the combined thickness t including the first adhesive layer 5, particle layer 6 and second adhesive layer 9 is approximately 100 microns.

Alternatively, it is also possible to first form a sheet or cylinder of 100 to 500 microns thick from a material of silicon rubber containing therein a dispersion of resin coated electrically conductive (A1) particles and then to place this sheet or cylinder fixedly on the surface of a dielectric layer 2*a* formed on an electrically conductive support 1. Thereafter, the outer surface of the sheet or cylinder is ground to have at least part of the conductive particles exposed at the surface, thereby completing a developer transporting unit. If desired, other resins than silicon rubber may also be used. Further, the surface grinding step may be omitted, if desired.

As described above, in accordance with the present invention, the conductive particles 6*a* to be used as floating electrodes as exposed at the surface are first embedded between the first and second adhesive layers 5, 9 so that they firmly cling to the structure even if they are partly exposed at the surface after the grinding step. Thus none of the exposed particles will be lost during operation. Moreover, since application of an adhesive material and deposition of conductive particles take place separately, formation of clumps or aggregates of particles may be advantageously avoided and the particles may be uniformly distributed across the entire surface. Besides, since the combined adhesive layer together with at least some of the embedded particles are ground from outside, the resulting surface is insured to be smooth and free of irregularities. Therefore, it is now possible to form a developer layer of uniform and desired thickness on the surface of the present developer transporting unit when used in a developing device. As will be described in detail later, the exposed conductive particles will function as floating electrodes to help increase image density when a line image of relatively lower surface potential is to be developed by a single component developer, e.g., magnetic toner.

In the above description, the underlying dielectric layer 2*a* is formed on the cylinder support 1; however, this layer may be discarded as long as the thickness t defined by the combined layers formed on the support 1 when completed is in a desired range and the particles 6*a* are electrically isolated from the support 1 to a sufficient level.

Figure 3B:
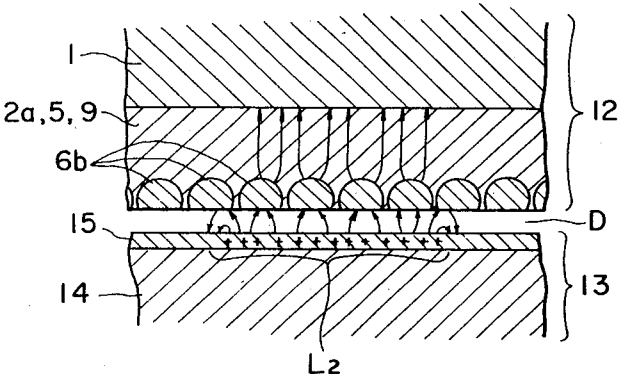
FIG. 3*b* is a schematic illustration when the present developing device is used for developing an area image.
Figure 3A:
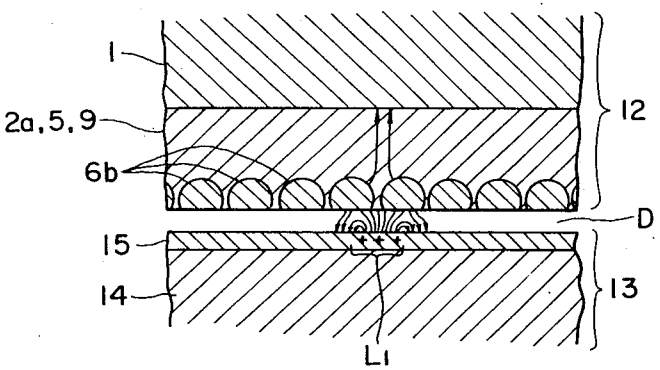
FIG. 3*a* is a schematic illustration when the present developing device is used for developing a line image.
Figure 5:
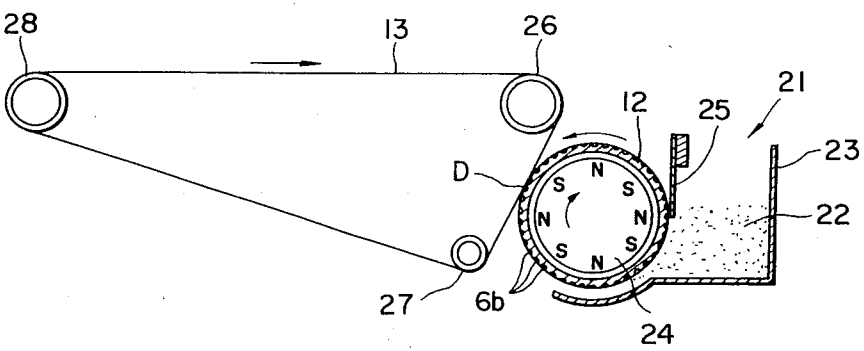
FIG. 5 is a schematic illustration showing when the present developer transporting unit is used as means for applying a quantity of developer under control to an electrostatic latent image formed on a photosensitive belt in a contact developing mode.
Figure 6:
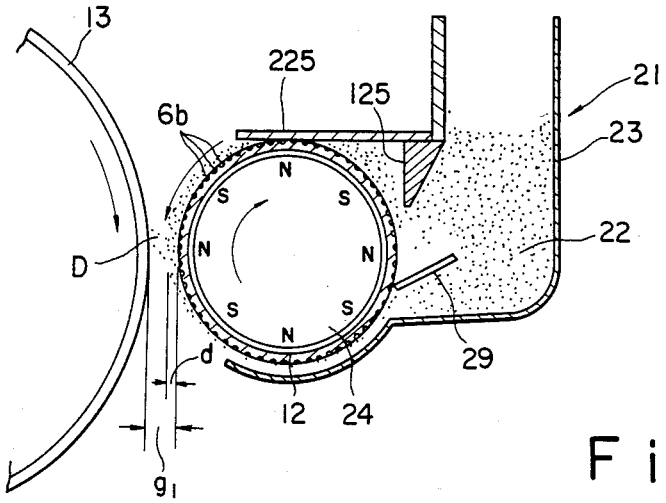
FIG. 6 is a schematic illustration showing when the present developer transporting unit is used as means for applying a regulated amount of developer to an electrostatic latent image formed on a photosensitive drum.

Now, in what follows, the following is a description of the principle of the developing operation when the developer transporting unit manufactured as described above is employed in a device for developing an electrostatic latent image formed on a photosensitive member with particular reference to FIGS. 3*a* and 3*b*. As shown, the present developer transporting unit 12 is positioned as opposed to a photosensitive member 13 with a small gap therebetween, thereby defining a developing region D as shown in FIGS. 5 and 6. As is well known in the electrostatographic technology, the photosensitive member 13 includes a conductive base 14, which is usually connected to ground, and a photosensitive layer 15 formed on the base 14. On the other hand, the developer transporting unit 12 for applying developer, e.g., magnetic toner, to an electrostatic latent image formed on the member 13 has the same structure as shown in FIG. 2*f* wherein like numerals are used to indicate like elements as practiced throughout the present specification. It should be noted, however, that, in FIGS. 3*a* and 3*b*, the dielectric layer 2*a*, and first and second adhesive layers 5, 9 are illustrated as a single layer for the sake of clarity.

It should also be noted that a layer of developer is, in fact, formed on the surface of the developer transporting unit 12 facing the photosensitive member 13, but such a developer layer is not shown in FIGS. 3*a* and 3*b*. The photoconductive layer 15 bears an electrostatic latent image $L_1$ in FIG. 3*a* or $L_2$ in FIG. 3*b* which is defined by electrostatic charges, positive in the illustrated example, having the polarity opposite to that of the developer. The latent image $L_1$ shown in FIG. 3*a* forms a line image; whereas, the latent image $L_2$ shown in FIG. 3*b* forms an area image. Accordingly, the only difference existing between the structures shown in FIGS. 3*a* and 3*b* is the class of the latent image formed in the photosensitive layer 15.

As is well known, developer/toner, which is not shown but carried on the developer transporting unit 12, is in part electrostatically attracted to the charges existing in the photoconductive layer 15 to define the latent image $L_1$ or $L_2$ and thus the latent image is developed to become a visualized image. In this instance, the amount of developer/toner attracted to the latent image $L_1$ or $L_2$ predominantly depends upon the intensity of the electric field in the neighborhood of the surface of the photoconductive layer 15. That is, the stronger the electric field is, the larger the amount of the developer attracted to the latent image $L_1$ or $L_2$ thereby increasing the image density of the developed image.

In the case of a line image as shown in FIG. 3*a*, electric field lines emanating from the latent image $L_1$ are mostly directed toward the background of the photoconductive layer 15 where no image is formed, and only some of the field lines are directed to the conductive support 1 of the developer transporting unit 12. This is due to the fact that a number of fine conductive particles 6*b* which are electrically isolated from one another and also from the conductive support 1 are present in the vicinity of the photoconductive layer 15 even though the conductive support 1 which functions as an opposite electrode to the photosensitive member 13 is present. In other words, presence of the conductive particles 6*b* tends to increase the number of field lines which are directed to the background from the latent image $L_1$ as compared with the case where no conductive particles 6*b* are present. Stated differently, presence of the conductive particles 6*b* contributes to make the dielectric thickness between the latent image $L_1$ and the background smaller as compared with the case where no conductive particles 6*b* are present. The above described phenomenon of increasing the field strength along the boundary between the latent image $L_1$ and the surrounding background is commonly referred to as the "edge effect" and presence of the conductive particles 6*b* in effect enhances this edge effect. For this reason, since the conductive particles 6*b* are present in the vicinity of the latent image $L_1$, the field strength around the latent image $L_1$ is significantly increased, which, in turn, attracts more developer/toner thereby allowing to form a developed image of increased image density as compared with the case where particles 6*b* are absent.

In the case of the latent image $L_2$ defining an area image as shown in FIG. 3*b*, almost all of the field lines emanating from the central portion of the latent image $L_2$ excepting those from its boundary are directed to the opposite electrode of the conductive support 1. This is because, in this case, the dielectric thickness between the internal portion of the latent image $L_2$ and the background of the photoconductive layer 15 is larger than the dielectric thickness between the internal portion of the latent image $L_2$ and the support 1. This phenomenon prevails irrespective of presence or absence of the conductive particles 6*b* so that the field strength in the vicinity of the central portion of the latent image $L_2$ is little affected by presence of the conductive particles 6*b* in the case of an area image.

Figure 4:
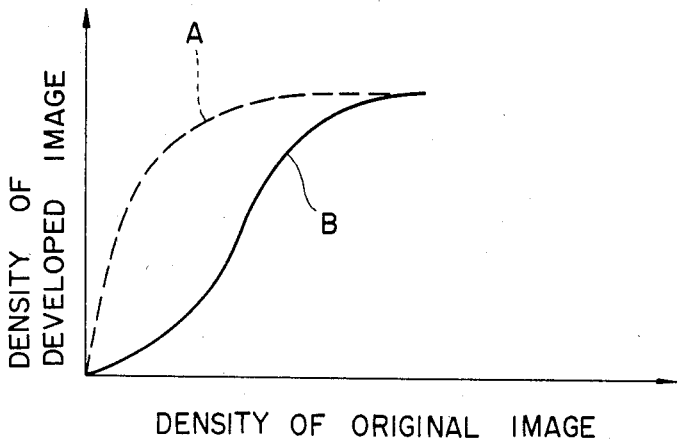
FIG. 4 is a graph showing an ideal relation between the density of an original image and the density of a developed image for a line image as well as for an area image.

As is apparent from the above description, presence of the conductive particles 6*b* has the advantage of increasing the developing efficiency only in the case of line images. Such a characteristic is qualitatively illustrated in FIG. 4 in which the abscissa indicates the density of an original image to be developed and the ordinate indicates the density of a developed image. As shown, the dotted line A shows a characteristic for line images and the solid line B shows a characteristic for area images. When the two characteristics are compared, it is obvious that the dotted line A has a significantly steeper slope, indicating that line images are developed with higher developing efficiencies as compared with area images if use is made of the developer transporting unit of the present invention. In the case of line images, it is almost always desirous to develop them with increased image density irrespective of the condition of original images, and thus the characteristics shown in FIG. 4 may be said to indicate ideal developing characteristics.

FIG. 5 schematically shows the structure of an electrophotographic copying machine including a developing device 21 in which the developer transporting unit 12 of the present invention is incorporated. The developing device 21 includes a tank 23 containing therein a quantity of single component developer 22 such as high resistivity magnetic toner. The volume resistivity of such toner should be $10^{10}$ ohms-cm or more. The developer transporting unit 12 is in the form of a sleeve having a number of floating electrodes 6*b* partly exposed at the outer peripheral surface. The sleeve-shaped developer transporting unit 12 is rotatably journaled to a machine housing (not shown) and it is driven to rotate in the direction indicated by the arrow. Inside the unit 12 is provided a magnet roller 24 having opposite polarities arranged alternately along its circumference. The magnet roller 24 is also supported rotatably and it is driven to rotate in the direction opposite to the developer transporting unit 12.

In operation, as the developer transporting unit 12 rotates, the magnetic toner 22 in the tank 23 are partly attracted to the unit 12 to be carried thereon. Then a blade 25 controls the amount of toner carried by the unit 12 as riding thereon. The blade 25 is made from a magnetic resilient plate and thus it is lightly pressed against the peripheral surface of the unit 12 due to the magnetic roller 24. Accordingly, the blade 25 controls the thickness of a developer layer to be formed on the unit 12 for application to an electrostatic latent image at a developing region D. As described previously, since the floating electrodes 6*b* are firmly fixed to the unit 12, they will not be lost even if the blade 25 is in scrubbing contact with the peripheral surface of the unit 12 thereby allowing to maintain a desired developing performance for an extended period of time.

As the developer transporting unit 12 rotates, the developer layer thus formed on the unit 12 is moved to the developing region D. It is to be noted that the toner particles forming the developer layer are charged to a predetermined polarity. On the other hand, a photosensitive belt 13 is extended around rollers 26, 27 and 28, and it is driven to travel in the direction indicated by the arrow. On the surface of the belt 13 is formed an electrostatic latent image by means of any well known device (not shown). The latent image is moved to the developing station D as the belt 13 advances, where the latent image becomes developed by attracting toner particles from the developer layer formed on the unit 12. In the structure shown in FIG. 5, the belt 13 is in pressure contact with the developer transporting unit 12 in order to effect contact developing. It will now be easily appreciated that the developer transporting unit 12 of the present invention may be advantageously employed for contact developing because of increased adherence of floating electrodes to its supporting structure. The developed image on the belt 13 will then be transferred to a transfer medium as is well known for those skilled in the art. On the other hand, the toner remaining on the developer transporting unit 12 after development will be returned to the tank for reuse.

FIG. 6 shows another developing device including the developer transporting unit 12 of the present invention when applied to an electrophotographic copying machine. As shown, the photosensitive member 13 is in the shape of a drum in this case, and the layer thickness control device includes a doctor blade 125 of a rigid body for roughly controlling the thickness of a toner layer and an auxiliary blade 225 for controlling the thickness of the toner layer to be uniform prior to application for development of a latent image. Provision is also made of a scraper 29 for scraping the remaining toner off the developer transporting unit 12 to be securely returned to the tank 23. In this case, the gap $g_1$ between the photosensitive drum 13 and the developer transporting unit 12 is relatively large and it is approximately 100 microns. On the other hand, the toner layer formed on the peripheral surface of the developer transporting unit 12 has the thickness d ranging from 20 to 30 microns. Accordingly, with the structure shown in FIG. 6, non-contact type developing takes place, and the present developer transporting unit 12 may be used equally advantageously.

In order to attain the electrode effect of the fine electrodes **6*b*, it is preferable to set the gap between an image supporting member on which a latent image to be developed is supported, e.g., photosensitive member, and a developer transporting unit on which a layer of developer is carried, e.g., developing sleeve, as small as possible. This then requires the thickness of a layer of developer to be formed on the developer transporting unit to be extremely thin. For this purpose, a thickness controlling member such as the blade 25 in FIG. 5** is used. However, when it is intended to limit the thickness of a developer layer to be extremely thin, another problem of maintaining the amount of developer transported at constant might become difficult. In order to cope with such a situation, small recesses having the representative size in the order of 0.5 to 3 times of the diamter of developer particles in the surface of the developer transporting unit on which a layer of developer is formed.

Figure 7:
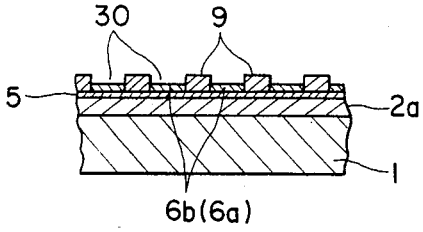
FIG. 7 is a cross-sectional view showing one embodiment of the developer transporting unit having a recessed surface on which a thin layer of developer is to be formed.

In order to manufacture such a developer transporting unit having a recessed surface, after grinding the second adhesive layer 9 to have at least a part of the conductive particles **6*a* exposed as shown in FIG. 2*f*, the thus ground surface may be subjected to sand blasting or etching to form small recesses therein. Further, when such small recesses are formed, it is preferable to have conductive electrodes located at the bottom of each recess because this will increase the developing efficiency. In this case, after grinding the second adhesive layer 9 to provide the structure as shown in FIG. 2*f*, a predetermined etchant is used to have the exposed portions of the conductive electrodes 6*b* etched away to define recesses 30 as shown in FIG. 7, thereby causing each of the conductive electrodes 6*b* to be located at the bottom of the corresponding recess 30**.

It should also be noted that as a material for forming conductive particles **6*b* functioning as auxiliary electrodes, use may be made of those materials including not only aluminum and iron, but also other magnetic or non-magnetic electrically conductive materials such as copper, bronze, nickel, ferrite, and stainless steel. The conductive particles 6*b*** may take any shape such as sphere, rectangle and polygon.

Figure 8:
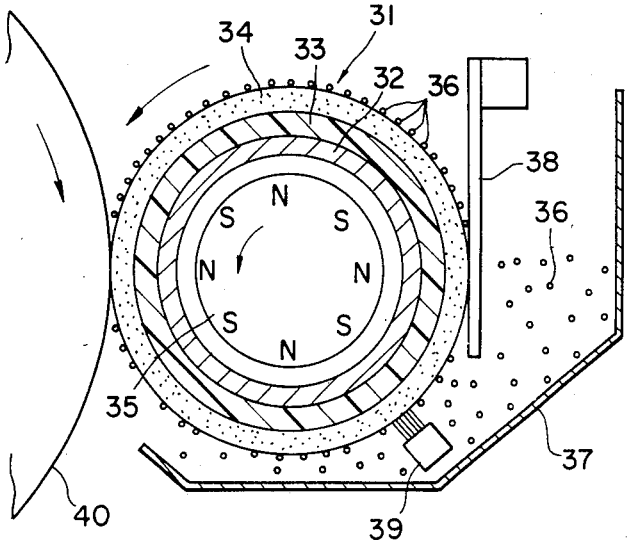
FIG. 8 is a schematic illustration showing a further embodiment of the present developing device.

FIG. 8 shows another embodiment of a developing device constructed in accordance with the present invention. As shown, the present developing device is provided as a component of an electrophotographic copying machine which includes a photosensitive drum 40 as an image support member, which is driven to rotate in the direction indicated by the arrow at constant speed. As is well known in the art, an electrostatic latent image may be formed on the peripheral surface of the drum 40 by applying any electrophotographic reproduction process which includes such steps as uniform charging and image exposure. The latent image formed will be brought to a developing station defined at the location where the drum 40 comes closest or opposite to a developing sleeve or developer transporting unit 31.

Similarly with the previous embodiments, the developing sleeve 31 comprises an electrically conductive base sleeve 32, a dielectric layer 33 formed on the outer peripheral surface of the base sleeve 32, and a dispersion layer 34 formed on the dielectric layer 33 and having a dispersion of fine metal particles. The dielectric layer 33 is of approximately 0.8 microns thick and it is formed, for example, by attaching a film of butadiene rubber having the rubber hardness of about 40° to the outer periphery of the base sleeve 32 using an appropriate adhesive.

On the other hand, the dispersion layer 34 may be formed in the following manner. First, fine metal particles of aluminum, nickel, iron, stainless steel, copper, etc., having the diameter in the range between 50 and 150 microns are mixed with liquid butadiene rubber approximately 30% by volume, and then such a dispersed system is applied to the outer peripheral surface of the dielectric layer 33 to the thickness of approximately 0.7 mm. Then sulfur is added to the thus applied dispersed system to have it vulcanized, followed by the step of grinding the outer surface to make the dispersion layer 34 to be of approximately 0.5 mm. By grinding, the metal fine particles are exposed at the surface as separated from each other and distributed uniformly. Since the dispersion layer 34 is formed on the dielectric layer 33 having rubber hardness of approximately 40°, the overall rubber hardness at the peripheral surface of the developer transporting unit 31 is approximately 60°. It is to be noted that use may be made any other elastic dielectric material for forming the dielectric layer 33 or the matrix of dispersion layer 34 than butadiene rubber described above. It is preferable however to make the dielectric layer 33 underlying the dispersion layer 34 to have a lower hardness value. In other words, the material and thickness of the underlying dielectric layer 33 should be so selected to give a sufficient amount of elasticity, thereby securing sufficient elasticity at the outer peripheral surface of the unit 31. On the other hand, it is preferable to use a relatively hard material for the matrix of the dispersion layer 34, which is preferably made as thin as practically possible. One of the reasons for using a relatively hard material for the matrix of the dispersion layer 34 is to prevent the metal fine particles from coming off at the surface grinding step thereby allowing to provide a smooth peripheral surface. Described more in detail, if the matrix material of the dispersion layer 34 is too soft, the metal fine particles dispersed therein tend to come off from the peripheral surface when ground. Moreover, if a difference in hardness between the matrix and the fine metal particles is rather large, smoothness of the resulting surface after grinding is rather poor mainly due to the difference in grinding efficiency between the two. As a result, there will be formed a large number of undesired pits or grooves at the resulting surface, and, therefore, it is difficult to form a thin layer of developer having a uniform thickness thereon. It is true, however, that using fine metal particles having a relatively lower hardness to make the difference in hardness between the matrix and the particles smaller, a smoother surface may be obtained. In this connection, it is possible to use electrical conductive particles of non-metal material instead of metal particles. As set forth above, the dispersion layer 34 should be made as thin as possible so as not to impair the overall elasticity of the unit 31 when a relatively hard material is used for the matrix.

The developer transporting unit 31 having the above-described structure is disposed to be in rolling contact with the drum 40 in the downstream of an image exposure station (not shown), and it is driven to rotate in the direction indicated by the arrow in synchronism with and at the same peripheral speed with the drum 40 by means of a driving means (not shown). A magnet roll 35 is disposed inside of and concentrically with the developing sleeve 31 and driven to rotate in the same direction as the sleeve 31. There is also provided a developer tank 37 in which a quantity of toner particles 36 are stored. The toner particles 36 are preferably magnetic toner particles including carbon black and magnetic powder, having, for example, the average diameter of approximately 8 microns and the true specific gravity of approximately 1.86. The toner particles preferably have volume resistivity of $10^{13}$ ohms-cm or more, and, thus, they may be triboelectrically charged to a predetermined polarity. Also shown in FIG. 8 is a doctor blade 38 for limiting a layer of toner particles formed on the peripheral surface of the developing sleeve 31 to a predetermined thickness. The blade 38 is made for example of an approximately 0.1 mm thick plate of SK material, which is magnetic in nature. The blade 38 is as wide as the developing sleeve and it is normally pressed against the outer periphery of the developing sleeve 31 because it is magnetically attracted by the magnet roll 35. Thus, when a quantity of toner particles are transported from the tank 37 as carried on the outer periphery of the developing sleeve 31 due to magnetic attraction to the line of contact between the sleeve 31 and the blade 38, these toner particles are formed into a thin layer of approximately 50 microns and at the same time charged to a predetermined polarity due to friction.

In the embodiment shown in FIG. 8, a brush 39 of electrically conductive material is disposed in the downstream of the developing station with its tip pointed toward the outer peripheral surface of the developing sleeve 31. The brush 39 is electrically connected to a predetermined potential, typically ground, and thus the remaining charge on the peripheral surface of the developing sleeve 31 after development is removed by the brush 39. If desired, an appropriate developing bias potential may be applied to the developing sleeve 31, and, in this case, the same bias potential may be applied to the base sleeve 32, blade 38 and brush 39.

As described previously, since at least the dielectric layer 33 is formed by a sufficiently elastic material, the developing sleeve 31 as a whole, in particular, its outer peripheral surface has a sufficient elasticity, so that the outer peripheral surface of the developing sleeve 31 may be brought into intimate contact with the surface of the photosensitive drum 40 without causing any deleterious effect, thereby allowing to carry out the contact development at high efficiency. Therefore, even if the surface of an image supporting structure is rather hard as in the case of a drum-shaped photosensitive member as described above, a developed image of high quality may be obtained by using the principle of the present invention. Furthermore, it is to be noted that the developing sleeve 31 includes a number of floating electrodes defined by the fine metal particles dispersed in the layer 34, which will allow to attain a desired developing characteristic in accordance with the kind of an original image, i.e., a line or area image, as discussed in detail previously.

Figure 9A:
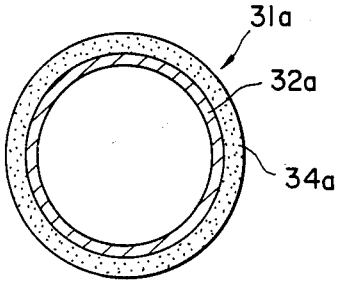
FIGS. 9*a* through 9*d* are cross-sectional views showing several modifications of the developer transporting unit of the developing device shown in FIG. 8.
Figure 9B:
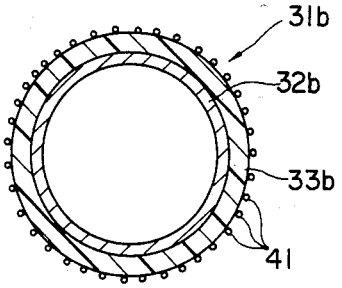

FIGS. 9*a* through 9*b* show several modifications of the developing sleeve 31 of the developing device shown in FIG. 8. FIG. 9*a* shows a developing sleeve 31*a* which includes a conductive base sleeve 32*a* and a dispersion layer 34*a* having a dispersion of fine metal particles formed around the base sleeve 32*a*. The dispersion layer 34*a* may be formed by having fine metal particles dispersed in a dielectric material, such as silicon rubber, NBR, butadiene rubber and chloroprene rubber, having sufficient elasticity. The outer periphery of the dispersion layer 34*a* is ground to have at least part of the fine metal particles exposed at the surface. In order to prevent the metal particles from coming off when ground, a coupling agent such as silane may be mixed in the dielectric material. In this embodiment, elasticity is provided by the dispersion layer 34*a*.

FIG. 9*b* shows a developing sleeve 31*b* which may be made in the following manner. First, on the outer periphery of a conductive base sleeve 32*b* is formed a dielectric layer 33*b* from a material same as used for forming the dielectric layer 33. Then after applying an adhesive agent to the outer periphery of the dielectric layer 33*b*, fine metal particles 41 are scattered onto the adhesive layer, followed by the step of applying a cover layer of adhesive agent on the first adhesive layer and the fine metal particles 41, thereby having the particles 41 fixed in position and electrically isolated from each other. Thereafter, the outer periphery is ground to have at least some of the embedded particles exposed at the surface and to provide a smooth peripheral surface. In this embodiment, elasticity is provided by the dielectric layer 33*b*, which may be formed from various materials mentioned above plus other materials such as sponge and sponge covered by a thermally shrinkable tube which is heat-treated to provide a desired hardness or elasticity.

Figure 9C:
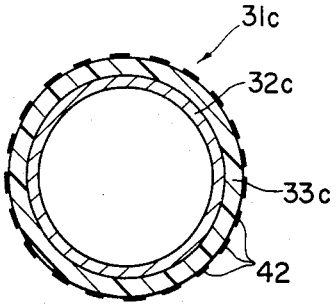
Figure 9D:
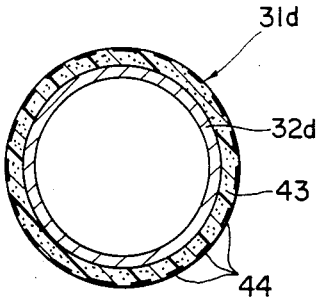

FIG. 9*c* shows another developing sleeve 31*c* which also includes a conductive base sleeve 32*c* and a dielectric layer 33*c* having enough elasticity formed on the base sleeve 32*c*. The outer periphery surface of the dielectric layer 33*c* is formed with finely divided small-sized electrodes in the form of isolated islands 42 by means of screen printing or laser scribing. On the other hand, FIG. 9*d* shows a developing sleeve 31*d* which includes a conductive base sleeve 32*d* and a dielectric layer 43 formed on the base sleeve 32*d* from porous sponge. The holes of the sponge present at the outer peripheral surface of the layer 43 are filled by fine metal particles 44 approximately same in size as the holes, and an adhesive agent is applied to have the particles 44 fixed in position. Alternatively, prior to the step of filling the holes with the fine metal particles 44, an elastic adhesive agent such as a rubber containing adhesive agent may be poured into the holes in order to provide an enhanced elasticity as well as fixing characteristic. Further, instead of metal particles 44, any paste-like electrically conductive material may be used to plug the holes at the peripheral surface.

Figure 10:
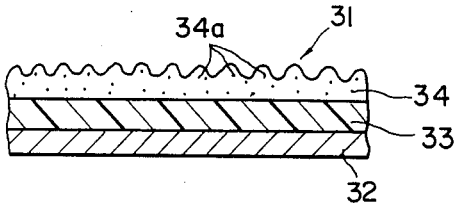
FIG. 10 is a cross-sectional view of another embodiment of the developer transporting unit having an irregular or wavy surface on which a thin layer of developer is to be formed.

FIG. 10 illustrates another embodiment of the developer transporting unit or developing sleeve 31. As shown, in this embodiment, the outer peripheral surface of the dispersion layer 34 is irregularly shaped such that the average roughness or representative size of this irregular surface is approximately 1 to 4 times of the average diameter of the toner particles used. As an example, the dielectric layer 33 may be formed to the thickness of approximately 1,000 microns on the surface of the base layer 32 having an appropriate thickness, and the dispersion layer 34 of a thermoplastic resin having dispersed therein iron particles of 30 to 40 microns in diameter is formed on the dielectric layer 33 to the thickness of approximately 100 microns. After heat treatment, the surface of the hardened dispersion layer 34 is roughened to provide an irregular surface having the representative size of 10 to 15 microns, for example, mechanically by sand blasting, knurling, etc., or chemically by etching.

If the surface irregularity of the dispersion layer 34 has a representative size, e.g., average roughness, which is equal to or smaller than the average diameter of toner particles used, then the irregular areas will be plugged by the toner particles when they are compressed at the contact line between the developing sleeve 31 and the blade 38, thereby providing a completely smoothed peripheral surface. When this happens, the amount of toner particles transported will be decreased and some of the toner particles could be crushed, which could cause a reduction in image density of a developed image and background contamination. On the other hand, if the representative size exceeds four times of the average diameter to the toner particles used, then it becomes difficult to triboelectrically charge a layer of the toner particles formed on the developing sleeve uniformly, which could also cause deleterious effects in a developed image. In view of the above, it is proposed to provide a surface irregularity having the representative size ranging from approximately one to four times of the average diameter of the toner particles used to the outermost layer 34, as shown in FIG. 10.

Figure 11:
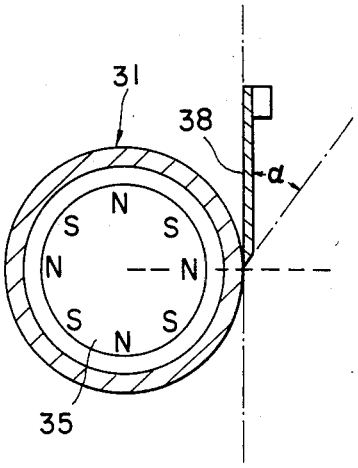
FIGS. 11 and 12 are schematic illustrations showing possible arrangements between the developer sleeve and the doctor blade in the present developing device.
Figure 12:
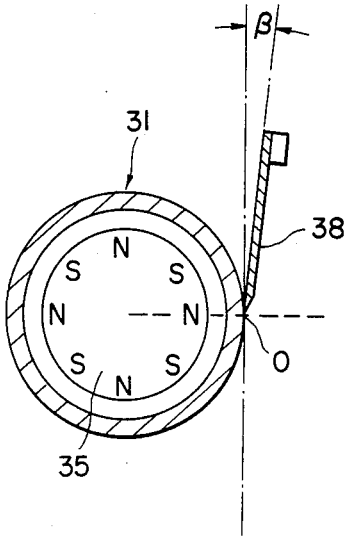

FIGS. 11 and 12 show particular arrangements of the doctor blade 38 which may be advantageously applied to the present developing device. In FIG. 11, the blade 38 is held vertically with its bottom end in contact with the periphery of the developing sleeve 31 such that the plane including the side surface of the blade 38 is substantially tangential to the contact line between the blade 38 and the sleeve 31. The bottom end face of the blade 38 is inclined to form a knife edge thereby defining an angle $\alpha$ as shown in FIG. 11, and this angle may be set in the range between 0° and 90°. In this embodiment, the tip end of the knife edge is in contact with the periphery of the sleeve 31. Such a structure may be advantageously used in combination with the developing sleeve 31 whose outer peripheral surface is appropriately roughened as described above. In other words, since there is no wedge-shaped space defined at the entrance side between the sleeve 31 and the blade 38, a thin film of toner particles may be formed on the sleeve 31 without streaks or any other irregularities in thickness and the amount of toner particles transported may be regulated to be constant.

FIG. 12 shows another arrangement of the blade 38 with respect to the developing sleeve 31. In this embodiment, however, the blade 38 is arranged such that there is defined an angle $\beta$ between the side surface of the blade 38 and the tangential line extending from the contact point O between the tip of the blade 38 and the peripheral surface of the sleeve 31. This angle is preferably set in the range between 0° and 30°.

Figure 13:
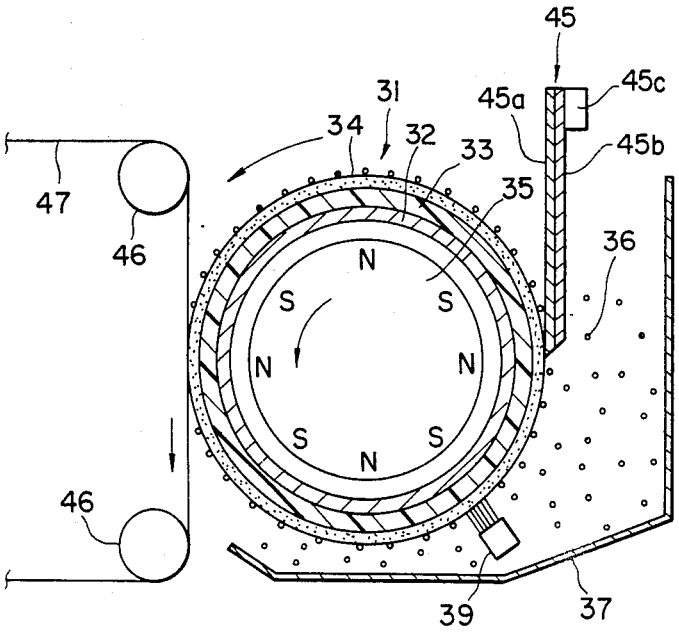
FIGS. 13 through 16 are schematic illustrations showing several other embodiments of the present developing device.

FIG. 13 shows a still further embodiment of the present developing device when applied to develop an electrostatic latent image formed on the surface of the photosensitive belt 47 passed around the rollers 46, 46. It is to be noted that the elements identified by the same numerals used in FIG. 8 indicate identical elements. In this case, the developing sleeve 31 is in pressure contact with the endless belt 47. This embodiment includes a composite blade 45 comprised of two plates 45*a* and 45*b* of different materials fixed together. For example, one plate may be formed by a rubber material with the other formed by a metal material. Preferably, at least one of them is magnetic in nature also. Such a composite structure is advantageous in providing a required characteristic as a doctor blade, e.g., flexibility, triboelectric chargeability, magnetic attractability and durability. It is also to be noted that the outer peripheral surface of the developing sleeve 31 is roughened as described previously.

Figure 14:
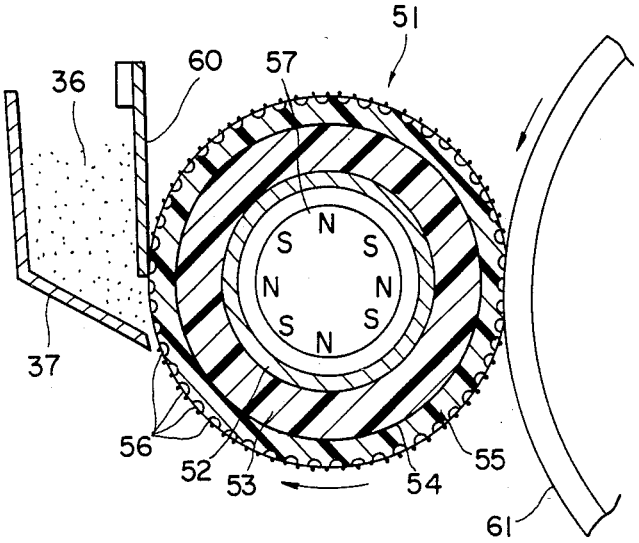
Figure 15:
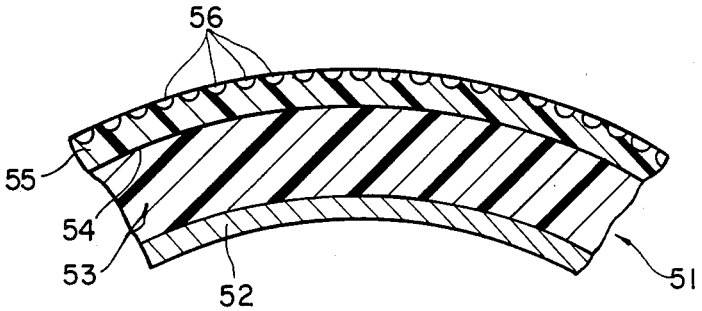

FIG. 14 shows a still further embodiment of the present developing device which includes a developing sleeve 51 having a four layer structure, when applied to an electrophtographic copying machine provided with a photosensitive drum 61 on which an electrostatic latent image to be developed is formed by any well known process. As illustrated on an enlarged scale in FIG. 15, the developer transporting unit or developing sleeve 51 has a four layer structure, including an electrically conductive base sleeve 52, a dielectric layer 53 formed on the base sleeve 52 from a dielectric material such as polyester and epoxy, an electrically conductive layer 54 formed on the dielectric layer 53 and another dielectric layer 55 formed on the conductive layer 54. The thickness and material of the inner dielectric layer 53 is preferably so selected to provide enough elasticity, and a dielectric material of high elasticity may also be used for the outer dielectric layer 55, if possible, taking other considerations into account as described in detail previously. Importantly, the outermost dielectric layer 55 includes a plurality of fine electrodes 56 at least at the exposed surface. These electrodes 56 are electrically floated and isolated from one another, thereby each forming an independent point electrode at the surface of the sleeve 51. They may be formed by having copper particles having the diameter ranging from 50 to 100 microns embedded in the dielectric layer 55 at least at or near the outer surface and then grinding the outer peripheral surface to have them exposed at the surface, whereby the copper particles are mostly cut into semi-spherical shapes. Inside the developing sleeve 51 is disposed a magnet roll 57 which may be rotated in either direction or may be held stationary,. Also disposed is a doctor blade 60 whose bottom end is in contact with the periphery of the developing sleeve 51 and which may be formed by a metal plate of SK material and 0.1 mm thick.

Figure 16:
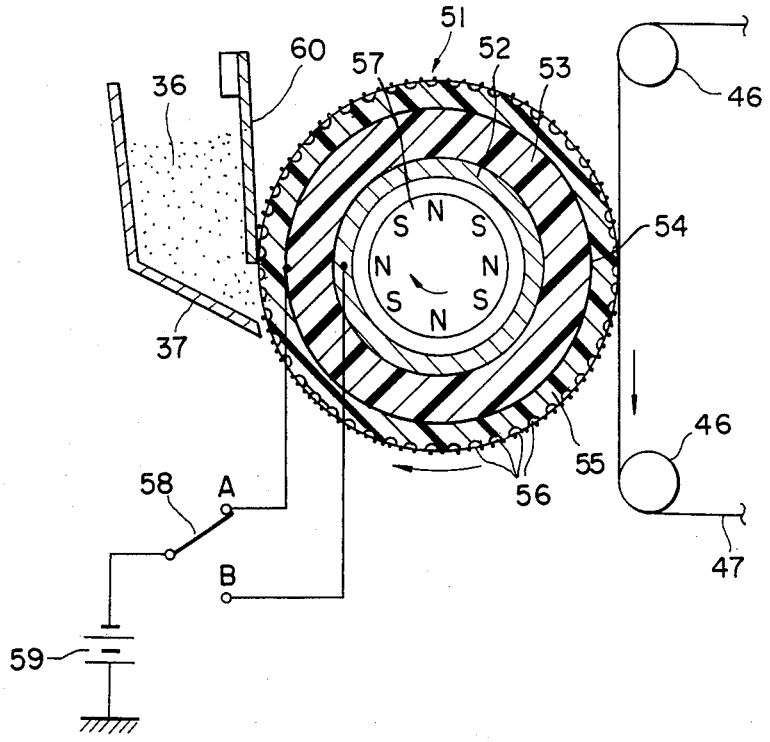

FIG. 16 shows a still further embodiment of the present developing device which has fundamentally the same structure as that of FIG. 14 excepting that a bias application device is provided and an endless belt type photosensitive member 47 is used instead of the drum type photosensitive member 61, though the latter difference is not critical to the present invention. Thus, like numerals are used to indicate like elements between FIGS. 14 and 16. As shown, a voltage supply 59 is provided such that a negative voltage may be applied to either of the inner and outer conductive layers 52 and 54 through a switch 58. Obviously, when the switch 58 is switched to a contact A, a predetermined bias potential is applied to the outer conductive layer 54; on the other hand, when switched to a contact B, the bias potential is applied to the inner conductive layer 52. When the bias potential is not applied, the conductive layer 52 or 54 is left electrically floating. The polarity of the bias potential is preferably selected to be opposite to that of the charge of toner particles used.

Figure 17A:
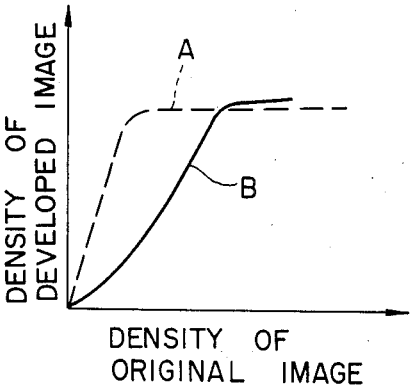
FIGS. 17*a* and 17*b* are graphs showing the developing characteristics which are useful for explaining the advantages of the embodiment shown in FIG. 16.
Figure 17B:
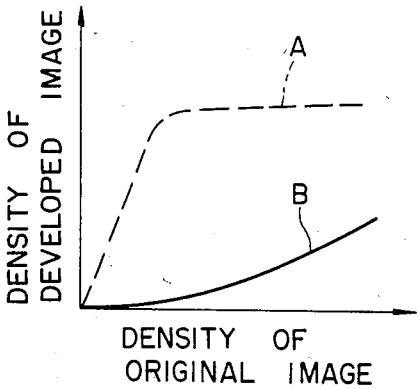

FIG. 17*a* illustrates the developing characteristics for both line (A) and area (B) images when a bias potential is applied to the outer conductive layer 54, or switch 58 turned to contact A; whereas, FIG. 17*b* illustrates the similar characteristics when a bias potential is applied to the inner conductive layer 52, or switch 58 turned to contact B. As is obvious from these characteristics, when the thickness of a dielectric layer is increased, i.e., switching from contact A to B, the developing characteristic of line image (A) remains unchanged, but that of area image (B) dramatically varies to a less steeper slope. This agrees with the finding that when the thickness of a dielectric layer was changed from 400 up to 1,000 microns, the developing characteristic of line image remained constant, while that of area image showed a variation toward a lesser steeper slope. A dielectric layer to be provided in a developing device of the type of the present invention is generally considered preferable to be of approximately 600 microns thick. However, in accordance with this embodiment, the thickness of such a dielectric layer may be arbitrarily selected and it may, for example, be as thick as 3,000 microns or more. In this case, however, an intermediate conductive layer must be provided such that an appropriate bias potential may be selectively applied, thereby allowing to adjustably set developing characteristics for area images.

Described more in detail with reference to FIG. 16, when the switch 58 is turned to contact B thereby applying a bias potential to the conductive base sleeve 52, the conductive layer 54 is left electrically floating, so that a capacitor is defined between the base sleeve 52 and the electrodes 56 across the dielectric layers 53 and 55, whereby since the thickness of the combined dielectric layer or inter-electrode distance is rather large, the developing curve for an area image exhibits a gentle slope, as shown in FIG. 17*b*. On the other hand, when the switch 58 is turned to contact A thereby applying a bias potential to the conductive layer 54, a capacitor is defined between the conductive layer 54 and the electrodes 56 across the dielectric layer 55, under which the developing characteristic curve for an area image will exhibit a steep slope, as shown in FIG. 17*a*. In this manner, in accordance with this embodiment of the present invention, a developing characteristic may be adjusted with ease as desired.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A device for developing an electrostatic latent image on an image supporting member by applying a single component developer to said latent image, comprising;

a tank for containing therein a quantity of developer;

developer transporting means for transporting said developer supplied from said tank along a predetermined path including a developing region where said electrostatic latent image may be developed, said developer transporting means including first electrode means and second electrode means which is electrically isolated from said first electrode means, said second electrode means including a plurality of fine electrodes which are electrically isolated from each other and each of which is previously coated with an insulating material having a volumetric resistivity of approximately $10^{12}$ ohms-cm or more to a thickness approximately ranging between 0.5 microns and 0.5 mm, at least some of said fine electrodes being exposed at the surface of said developer transporting means of which said film of developer is formed: and means for forming a film developer of a predetermined thickness on said developer transporting means before reaching said developing station.

2. A device of claim 1 further comprising means for keeping said developer attracted to said developer transporting means while said developer is being transported along said predetermined path.

3. A device of claim 1 wherein said developer includes electrically insulating and magnetically attractable toner particles and said means for keeping includes a magnet.

4. A device of claim 1 wherein said first electrode means is maintained at a predetermined potential.

5. A device for developing an electrostatic latent image on an image supporting member by applying a single component developer thereto, comprising:

a tank for containing therein a quantity of developer;

a developing sleeve driven to rotate in a predetermined direction, said sleeve including an electrically conductive cylinder, a dielectric layer formed on said cylinder and a plurality of fine electrodes provided at least at the outer peripheral surface of said dielectric layer, each of said fine electrodes being previously coated with an insulating material having a volumetric resistivity of $10^{12}$ ohms-cm or more to a thickness apparoximately ranging between 0.5 microns and 0.5 mm;

means for attracting said developer to the outer peripheral surface of said developing sleeve; and means for forming a film of said developer of a predetermined thickness on the outer peripheral surface of said developing sleeve.

6. A device for developing an electrostatic latent image on an image supporting member by applying a single component developer thereto, comprising:

a developer transporting means for transporting said developer along a predetermined path including a developing station where said latent image may be developed, said developer transporting means including an electrically conductive base, a dielectric layer formed on said base and a plurality of fine electrodes provided electrically isolated from each other at least at the outer surface of said dielectric layer, said dielectric layer having a substantial eleasticity and a hardness of 75° or less, and means for supplying (a) said developer to said developer transporting means.

7. A device of claim 6 wherein said dielectric layer comprises an elastic dielectric material.

8. A device of claim 7 wherein said elastic dielectric material is selected from the group mainly consisting of silicon rubber, NBR, butadiene rubber, chroloprene rubber and sponge.

9. A device for developing an electrostatic latent image on an image supporting member by applying a single component developer, comprising:

developer transporting means for transporting said developer along a predetermined path including a developing station where said latent image may be developed, said developer transporting means including an electrically conductive base, a first dielectric layer formed on said base, a second dielectric layer formed on said first dielectric layer and a plurality of fine electrodes provided electrically isolated from each other at least at the outer surface of said second dielectric layer, whereby said first dielectric layer has a hardness which is lower than that of said second dielectric layer; and means for supplying said developer to said developer transporting means.

10. A device for developing an electrostatic latent image on an image supporting member by applying a single component developer thereto, comprising:

developer transporting means for transporting said developer along a predetermined path including a developing station where said latent image may be developed, said developer transporting means including first electrically conductive layer, a first dielectric layer formed on said first conductive layer, a second electrically conductive layer formed on said first dielectric layer, a second dielectric layer formed on said second conductive layer and a plurality of fine electrodes provided electrically isolated from each other at least at the outer surface of said second dielectric layer; and means for supplying said developer to said developer transporting means.

11. A device of claim 10 wherein at least said first dielectric layer has a substantial elasticity.

12. A device of claim 11 further comprising means for selectively applying a bias potential to one of said first and second conductive layers.

13. A device of claim 12 wherein either of said first and second conductive layers is left electrically floating when said bias potential is not applied.

14. A device for developing an electrostatic latent image on an image supporting member by applying toner particles thereto, comprising:

transporting means including an outer surface to which said toner particles are attracted so as to be transported along a predetermined path including a developing station where said latent image may be developed, said surface being roughened to have a representative size which is approximately one to four times the average diameter of said toner particles; and supplying means for supplying said toner particles to said transporting means.

15. A device of claim 14 wherein said representative size is the average roughness of said surface.

16. A device of claim 14 wherein said supplying means includes a doctor blade which is disposed such that its distal end is in pressure contact with the surface of said transporting means for forming a film of said toner particles on said surface before reaching said developing station.

* * * * *

UNITED STATES PATENT AND TRADEMARK OFFICE

CERTIFICATE OF CORRECTION

PATENT NO. : 4,564,285

DATED : January 14, 1986

INVENTOR(S) : Wataru Yasuda, Koji Sakamoto, Fuchio Kanno

It is certified that error appears in the above-identified patent and that said Letters Patent is hereby corrected as shown below:

"Inventors" is amended to include Toshio Kaneko of Tokyo, Japan.

Signed and Sealed this

Twenty-eighth Day of March, 1989

*Attest:*

DONALD J. QUIGG

*Attesting Officer*

*Commissioner of Patents and Trademarks*